US005619875A

United States Patent [19]

Lahaussois

[11] Patent Number: 5,619,875

[45] Date of Patent: Apr. 15, 1997

[54] FLEXIBLE RING DEVICE

[76] Inventor: Pierre Lahaussois, 25-13 Old Kings Hwy. North, Darien, Conn. 06820

[21] Appl. No.: 399,423

[22] Filed: Mar. 7, 1995

[51] Int. Cl.[6] ..... A44B 15/00

[52] U.S. Cl. ..... 70/457; 70/456 R; 70/458; 24/3.6

[58] Field of Search ..... 70/14, 19, 456 R–459; 24/3.6, 616, 590

[56] References Cited

U.S. PATENT DOCUMENTS

| | | | |
|---|---|---|---|
| 66,244 | 7/1867 | Moulton . | |
| 86,424 | 2/1869 | Libbey . | |
| 376,453 | 1/1888 | Scott | 70/457 |
| 561,855 | 6/1896 | Baptist . | |
| 1,172,374 | 2/1916 | Leimer . | |
| 1,435,347 | 11/1922 | Taylor . | |
| 2,574,579 | 11/1951 | McCoy et al. | 24/123 |
| 2,771,768 | 11/1956 | Tudor | 70/457 |
| 2,938,375 | 5/1960 | Wehrli | 70/459 |
| 2,969,668 | 1/1961 | Aitchison | 70/458 |
| 3,237,977 | 3/1966 | Batchelder | 287/119 |
| 3,852,982 | 12/1974 | Faris | 70/458 X |
| 3,881,334 | 5/1975 | Wilson | 70/457 |
| 5,359,870 | 11/1994 | Reutlinger | 70/456 R |

FOREIGN PATENT DOCUMENTS

| | | | |
|---|---|---|---|
| 455207 | 7/1913 | France | 70/458 |
| 1505571 | 11/1967 | France | 70/458 |
| 248593 | 12/1911 | Germany | 70/457 |

*Primary Examiner*—Suzanne Dino
*Attorney, Agent, or Firm*—Schweitzer Cornman Gross & Bondell LLP

[57] ABSTRACT

A flexible ring device, such as a key ring for example, is formed of a section of flexible material, such as metal cable or plastic anchored at one end to a coupling sleeve. The free end of the flexible section carries a coupling plug which can be inserted axially to an open end of the coupling sleeve. The coupling sleeve is formed with a locking notch, preferably a through opening, facing radially inwardly with respect to the closed ring. When the coupling plug is inserted into the open end of the coupling sleeve, and past the locking notch, a locking portion, formed by the back end of the coupling plug, is resiliently displaced into locking engagement with a shoulder formed by the locking notch. The device is thus locked in a closed configuration against being opened by tension forces. The device can be easily opened by manually re-aligning the coupling plug with the axis of the coupling sleeve and withdrawing the plug axially from the open end of the sleeve.

4 Claims, 2 Drawing Sheets

10
11
12
13
15
16
19

12
13
14
15
16
17
18
19
20
21
22
5

FLEXIBLE RING DEVICE

BACKGROUND AND SUMMARY OF THE INVENTION

The present invention is directed to a flexible ring device, useable as key ring, locking ring, etc., which is simple, economical to manufacture and easy to use. In particular, the invention is directed to a closable ring device in which the principal ring element is a short section of flexible material, with a unique and advantageous arrangement for joining and releasing opposite ends of the flexible section for opening and closing the ring.

The prior art contains examples of key rings and the like of this general type, comprising a section of flexible metal cable, for example, and a connector means for joining and releasing the cable ends. An early form of such device is reflected in the Tudor U.S. Pat. No. 2,771,768, in which opposite ends of a flexible cable can be joined and released by a twisting motion of the cable. A later device, reflected in the Faris U.S. Pat. No. 3,852,982, utilizes a short section of flexible cable and a ball and socket-type connector means at the cable ends. The ball end can be inserted into a lateral opening in the companion coupling member, and then slid into a restricted slot, from which the ball portion can not easily be removed. The normal resilience of the cable element tends to maintain the ball element in the restricted slot during normal usage. In the Reutlinger U.S. Pat. No. 5,359,870, a spring actuated ball chuck captures one end of a flexible cable section. The cable is automatically locked by spring action of the chuck, and is released by manually pressing a chuck plunger in the opening direction.

In accordance with the present invention, an improved closable ring arrangement is provided, in which the opposite ends of a flexible section may be locked in a closed configuration by simple axial insertion of the free end of the flexible section into a cylindrical coupling device. Unlike the device of the Tudor patent, which must be gripped firmly enough at its opposite ends to be twisted for coupling and decoupling, and unlike the device of the Faris patent, in which the opposite ends of the key ring must be disposed nearly at right angles for coupling and uncoupling, the device of the present invention is coupled and uncoupled by an axial end-on motion. Although an axial coupling and uncoupling motion is provided for in the device of the Reutlinger patent, the device of that patent is unnecessarily complicated and expensive for a key ring device, requiring several moving parts. With the device of the present invention, by contrast, the free end of the flexible element is inserted axially into a cylindrical coupling. When tension is applied to the closed ring, the free end is automatically locked by a coupling sleeve. Disengagement of the coupling, and opening of the key ring is enabled by a simple, easily accomplished alignment of the free end of the flexible element with the coupling sleeve, followed by axial withdrawal.

In a preferred embodiment of the invention, useful as a key ring, for example, one end of a resilient flexible element is permanently affixed to one end of a short cylindrical coupling sleeve. The free end of the flexible element carries a coupling plug, arranged to be closely received within the coupling sleeve. Adjacent the free end of the coupling sleeve, there is a notch which forms an inwardly facing locking shoulder. When the ring is to be closed, the coupling plug is inserted into the sleeve to a point at least slightly beyond the shoulder. By merely releasing the flexible element, the normal resilience of the flexible element, which tends to restore it to a generally straighter configuration, tilts the coupling plug to cause it to engage the locking shoulder. The coupling plug is thus locked against axial withdrawal from the coupling sleeve, and the ring remains firmly and reliably locked in its closed configuration, until intentionally released. Opening of the ring is achieved by overcoming the natural resilience of the flexible element sufficiently to align the free end of the flexible element generally with the axis of the coupling sleeve, whereupon the coupling plug may be easily withdrawn axially out of the open end of the sleeve.

The device is simple, inexpensive, attractive and easy to use.

For a more complete understanding of the above and other features and advantages of the invention, reference should be made to the following detailed description of a preferred embodiment of the invention and to the accompanying drawings.

DESCRIPTION OF PREFERRED EMBODIMENTS

Figures 1, 2:
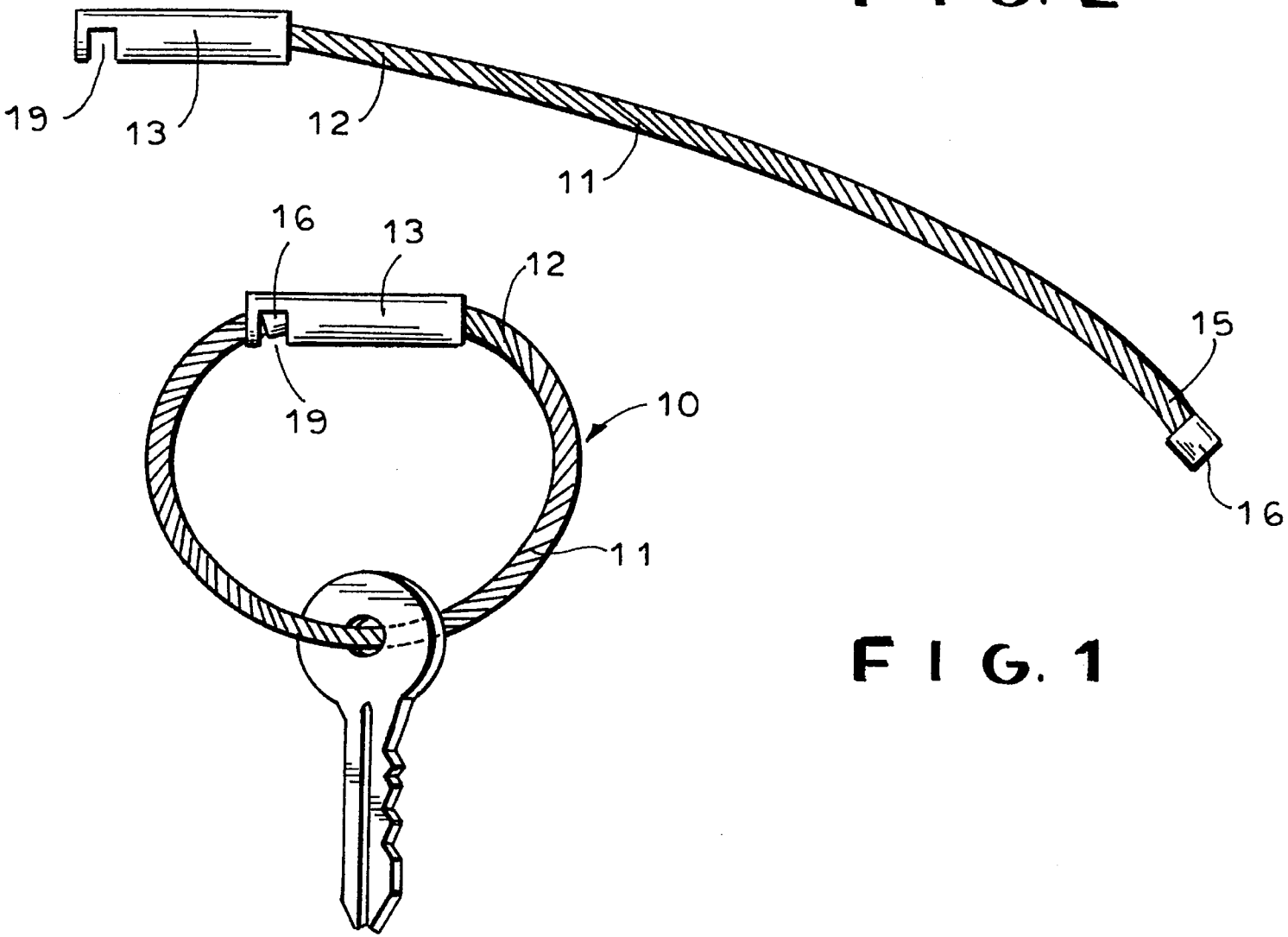
FIG. 1 is an elevational view of a ring device according to the invention, shown in a closed configuration.
FIG. 2 is an elevational view of the ring device of FIG. 1, shown in an open configuration.

Referring now to the drawings, the reference numeral 10 designates a ring device according to the invention, which, for purposes of illustration may be a key ring. The ring device is comprised of a section of resilient flexible material 11, for example thin metal cable, which is anchored at one end 12 to the end of a cylindrical coupling sleeve 13. In the illustrated arrangement, the anchored end 12 of the flexible section is swage-fitted to a short, cylindrical anchoring plug 14, which is tightly received within the hollow interior of the coupling sleeve. The plug 14 is permanently secured in the sleeve 13 by any suitable means, such as by swaging down the end of the sleeve, by initially inserting the plug against a tight interference fit, etc., so that the end 12 of the flexible section is firmly and permanently fixed to the end of the coupling sleeve 13.

To advantage, the flexible section 11 may be a cable formed of tightly wound, multi-strand, fine stainless steel wire, preferable wound to resist twisting, in either direction. Conventional rigging wire is particularly suitable. Such wire has a multi-strand core wound in one direction and surrounded by a multi-strand sheath of fine wires wound in the opposite direction. Fine flexible cable of this type is commonly used in the rigging of small sailboats, for example, and is readily available at reasonable cost. Other suitable materials are flexible plastics.

According to one aspect of the invention, the free end 15 of the flexible section 11 carries a coupling plug 16 which, in the illustrated device, is a generally cylindrical plug similar to the anchoring plug 14, but slightly smaller in diameter so as to slide freely into the hollow interior 17 of the coupling sleeve. As in the case of the anchoring plug 14, the coupling plug 16 may be suitably swaged onto the free end of the flexible section so as to be permanently secured thereto. The size and shape of the coupling plug 16 are such that the plug can be easily inserted into and (when properly aligned) easily removed from the cylindrical interior 17 of the coupling sleeve 13.

In a preferred form of the invention, the coupling sleeve 13 is provided at its open end 18 with a notched opening 19. The length of the opening, measured axially of the coupling sleeve, is preferably less than the length of the coupling plug 16. The depth of the notch 19 preferably is substantially one half the diameter of the coupling sleeve, so that the sleeve is notched approximately halfway through its side wall 20. The notch 19 is placed a short distance inward from the open end 18 of the coupling sleeve, and forms an axially inwardly facing locking shoulder 21 along one side edge.

Figures 3, 4, 5:
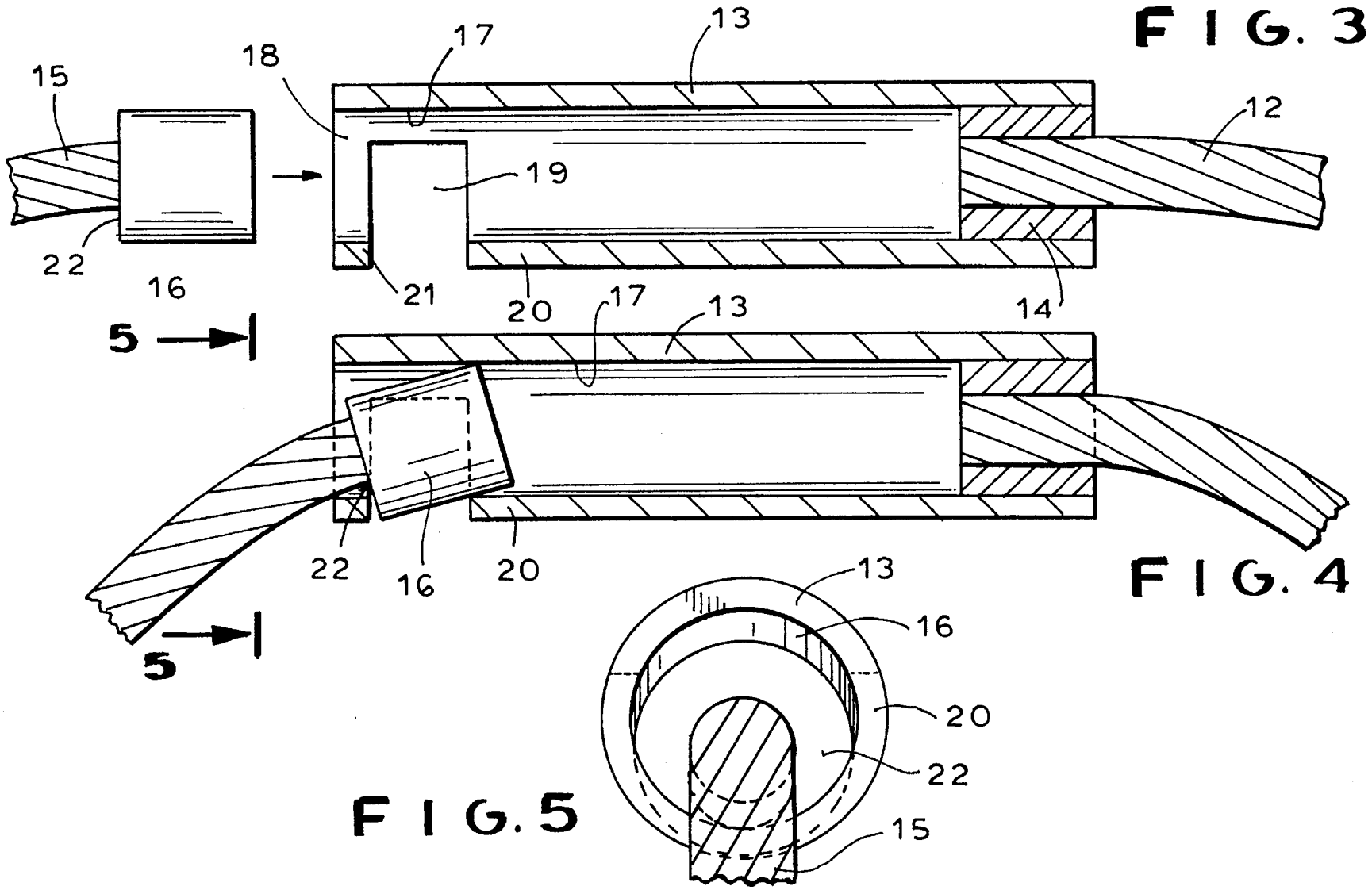
FIG. 3 is an enlarged, fragmentary cross sectional view showing details of the coupling sleeve and illustrating the manner in which the free end of a flexible section is joined with a coupling sleeve to form a closed ring.
FIG. 4 is a cross sectional view, similar to FIG. 3, showing the manner in which the coupling sleeve locks together with a coupling plug to secure the ring device in closed configuration.
FIG. 5 is an enlarged sectional view, as taken generally on line 5—5 of FIG. 4.

As reflected in FIGS. 3 and 4, the ring is brought to a closed configuration by aligning the coupling plug 16 with the internal cavity 17 of the coupling sleeve and sliding the coupling plug to a point where its back surface 22, forming a locking portion, lies inward of the locking shoulder 21. Because of its natural resilience, the flexible element 11 tends to return toward a relatively straight configuration, as soon as it is released by the user. Thus, after insertion of the coupling plug 16, the coupling plug automatically tends to assume a cocked or tilted position within the coupling sleeve. This tendency exists regardless of where, within the coupling sleeve, the coupling plug is located. Thus, as long as the plug is inserted to a position past the locking shoulder 21, as soon as any tension is applied to the flexible element 11 tending to withdraw the coupling plug, the plug automatically tilts so that the back surface 22 of the coupling plug engages the locking shoulder 21 and locks the ring device in a closed configuration.

The degree to which the coupling plug 16 tilts within the coupling sleeve 13 is a function of both the size and configuration of the locking plug. A purely cylindrical plug, generally as shown in the drawings, is preferably slightly smaller in diameter than the interior cavity of the coupling sleeve, to facilitate such tilting. Additionally, the coupling plug may be given a slightly frusto-conical configuration, or the forward portion of the coupling plug can be slightly tapered or rounded. The axial length of the notch 19 also plays a part, with longer notches facilitating the desired tilting action of the coupling plug. Preferably, the axial length of the notch 19 is less than that of the coupling plug 16.

In the preferred and illustrated embodiment of the invention, the notch 19 faces generally radially inwardly of the closed loop, as shown in FIG. 1. This both facilitates the initial coupling operation and assures that the natural resilient tendency of the resilient flexible element 11 to resume a relatively straight open configuration, as shown in FIG. 2, operates in the proper direction to reliably achieve proper coupling between a locking portion of the coupling plug 16 and the locking shoulder 21. To this end, the element 11 is desirably given an initial prebend in the direction of the notch 19 and generally in a plane which includes the longitudinal axis of the coupling sleeve 13 and substantially bisects the notch 19. With a small amount of permanent prebend in such direction and in such plane, the notch 19 will naturally orient itself to face radially inward of the closed ring, in the manner shown in FIG. 1.

In the illustrated and preferred form of the invention, all of the materials employed preferably are suitable metals. For example, the flexible element and the coupling sleeve 13 may be formed of stainless steel, the anchoring and coupling plugs 14, 16 are suitably formed of a somewhat softer material, such as brass. If desired, however, some or all of the materials may be formed of plastic to provide a ring device of lower cost but lesser durability. Where desired, the entire device may be formed as a single injection molded unit.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A ring device of the type comprising a section of resilient flexible material having a free end and an anchored end, and a coupling member secured to the anchored end of said flexible section and adapted to releasably secure the free end of said flexible section, characterized by (a) said coupling member having first and second opposite ends and said first end being connected to the anchored end of said flexible section, (b) said coupling member being of tubular configuration in a region thereof adjacent to the second end thereof and being open at said second end, (c) a coupling plug having front and back ends and being secured at its back end to the free end of said flexible section, (d) said back end of said coupling plug having larger external thickness dimensions than said flexible section forming a locking shoulder at said back end, (e) the open second end of said coupling member, and said adjacent region of tubular configuration, having internal dimensions larger than the external thickness dimensions of said back end of said coupling plug, (f) said coupling plug being of a size and cross sectional shape adapted for free axial reception into the open end and adjacent tubular region of said coupling member and for being locked therein, the absence of torsional distortion of said flexible section, whereby said flexible section and coupling member form a closed ring, (g) said coupling member having a locking notch formed in a side wall portion thereof oriented toward the inside of said closed ring, said locking notch forming an axially inwardly facing abutment surface, (h) the locking shoulder at the back end of said coupling plug being lockingly engageable with said axially inwardly facing abutment surface when said coupling plug is inserted axially and without torsional distortion into said open end and adjacent tubular region to a position in which said coupling plug locking shoulder is positioned at a greater distance from said coupling member open end than is said axially inwardly facing abutment surface, (i) said flexible section having characteristics of resilience normally urging said section toward a configuration less curvature than said closed ring, whereby said coupling plug is urged to assume a tilted position within said coupling member, thus causing said locking shoulder to be lockingly engaged with said abutment surface.

2. A ring device according to claim 1, wherein said flexible section is given a permanent, curved pre-bend in a predetermined direction relative to said locking notch, to facilitate further bending of said flexible section in said predetermined direction to form a closed ring.

3. A ring device according to claim 1, wherein (a) said locking notch is a through opening formed in the side wall of said coupling member and defining said inwardly facing abutment surface, and (b) the locking shoulder of said coupling plug being lockingly engageable with said abutment surface when said coupling plug is in said tilted position within said coupling member.

4. A ring device according to claim 1, wherein said flexible section is formed of multi-strand metal wire cable.

* * * * *